US007100311B2

(12) United States Patent
Verseef

(10) Patent No.: US 7,100,311 B2
(45) Date of Patent: Sep. 5, 2006

(54) GATE ASSEMBLY AND METHOD FOR A SNOW PLOW BLADE

(75) Inventor: Jan Verseef, Heiloo (NL)

(73) Assignee: Schmidt Engineering and Equipment, Inc., New Berlin, WI (US)

( * ) Notice: Subject to any disclaimer, the term of this patent is extended or adjusted under 35 U.S.C. 154(b) by 52 days.

(21) Appl. No.: 10/841,811

(22) Filed: May 7, 2004

(65) Prior Publication Data

US 2005/0246926 A1 Nov. 10, 2005

(51) Int. Cl.
*E01H 5/04* (2006.01)
*E02F 3/76* (2006.01)

(52) U.S. Cl. ..... 37/234; 172/815

(58) Field of Classification Search ..... 37/234, 37/281, 274; 172/815, 811, 810
See application file for complete search history.

(56) References Cited

U.S. PATENT DOCUMENTS

| | | | |
|---|---|---|---|
| 294,084 | A | 2/1884 | Schulze |
| 446,326 | A | 2/1891 | Chambers |
| 509,303 | A | 11/1893 | Fisher |
| 977,724 | A | 12/1910 | Friedman |
| 1,147,122 | A | 7/1915 | Scheiden |
| 1,202,062 | A | 12/1916 | Hedley et al. |
| 1,396,846 | A | 11/1921 | Jezova |
| 1,462,901 | A | 7/1923 | Brecht |
| 1,534,611 | A | 4/1925 | Schmidt |
| 1,560,612 | A | 11/1925 | Sims |
| 1,645,837 | A | 10/1927 | Wadsworth |
| 1,816,389 | A | 7/1931 | Moberg |
| 1,999,226 | A | 4/1935 | Wold |
| 2,055,840 | A | 9/1936 | Girard |
| 2,095,096 | A | 10/1937 | Humphrey |
| 2,355,160 | A | 8/1944 | Hodsdon |
| 2,768,454 | A | 10/1956 | Schmechel |
| 2,825,985 | A | 3/1958 | Weeks |
| 2,847,770 | A | 8/1958 | Wright |
| 2,870,469 | A | 1/1959 | Meece |
| 3,028,692 | A | 4/1962 | Brock |
| 3,091,999 | A | 6/1963 | MacDonald |
| 3,156,937 | A | 11/1964 | Weir |
| 3,231,991 | A | 2/1966 | Wandscheer et al. |
| 3,279,104 | A | 10/1966 | Wandscheer et al. |
| 3,598,186 | A | 8/1971 | Coontz |
| 3,659,363 | A | 5/1972 | Snyder |
| 3,680,451 | A | 8/1972 | Birtchet |
| 3,744,568 | A | 7/1973 | Beyers et al. |
| 3,762,077 | A | 10/1973 | Henry et al. |

(Continued)

FOREIGN PATENT DOCUMENTS

| | | |
|---|---|---|
| DE | 2519112 | 11/1976 |

(Continued)

*Primary Examiner*—Christopher J. Novosad
(74) *Attorney, Agent, or Firm*—Michael Best & Friedrich LLP

(57) ABSTRACT

Some embodiments of the present invention provide a snow plow blade gate apparatus and method in which the gate is pivotably attached to an end of a snow plow blade. The gate can be pivotable between a deployed position in which the gate blocks snow from exiting the snow plow blade to a stowed position in which at least part of the gate is moved to a location behind the snow plow blade. In some embodiments, the gate pivots about an axis skewed with respect to a substantially vertical plane. Also, some embodiments of the present invention have an actuator that can be actuated to secure the gate in a deployed position.

40 Claims, 9 Drawing Sheets

U.S. PATENT DOCUMENTS

| | | | |
|---|---|---|---|
| 3,772,803 | A | 11/1973 | Cote |
| 3,777,822 | A | 12/1973 | Stedman et al. |
| 3,924,285 | A | 12/1975 | Hukuba |
| 4,077,139 | A | 3/1978 | Fagervold et al. |
| 4,079,791 | A | 3/1978 | Yoder et al. |
| 4,208,812 | A | 6/1980 | Brownly |
| 4,249,323 | A | 2/1981 | Mathis et al. |
| 4,356,645 | A | 11/1982 | Hine et al. |
| 4,357,766 | A | 11/1982 | Croteau et al. |
| 4,429,433 | A | 2/1984 | Burgoon |
| 4,457,036 | A | 7/1984 | Carlson et al. |
| 4,552,226 | A | 11/1985 | Platter |
| 4,568,028 | A | 2/1986 | Verseef et al. |
| 4,669,205 | A | 6/1987 | Smathers |
| 4,685,228 | A | 8/1987 | Gisler et al. |
| 4,727,665 | A | 3/1988 | Verseef |
| 4,741,116 | A | 5/1988 | Engle et al. |
| 4,760,657 | A | 8/1988 | Ganzmann et al. |
| 4,827,637 | A | 5/1989 | Kahlbacher |
| 4,834,191 | A | 5/1989 | Vecchio |
| 4,837,951 | A | 6/1989 | Verseef |
| 4,962,600 | A | 10/1990 | Zellaha et al. |
| 5,025,577 | A | 6/1991 | Verseef |
| 5,048,207 | A | 9/1991 | Verseef |
| 5,191,729 | A | 3/1993 | Verseef |
| 5,239,720 | A | 8/1993 | Wood et al. |
| 5,344,254 | A | 9/1994 | Sartain |
| 5,375,349 | A | 12/1994 | Jochim |
| 5,638,618 | A | 6/1997 | Niemela et al. |
| 5,665,318 | A | 9/1997 | Rembold et al. |
| 5,697,172 | A | 12/1997 | Verseef |
| 5,743,032 | A | 4/1998 | Vauhkonen |
| 5,758,728 | A | 6/1998 | Ragule |
| 5,794,710 | A | 8/1998 | Maxwell |
| 5,797,203 | A | 8/1998 | Vanderlinden |
| 5,819,444 | A | 10/1998 | Desmarais |
| 5,829,174 | A | 11/1998 | Hadler et al. |
| 5,894,689 | A | 4/1999 | Turk |
| 5,899,007 | A | 5/1999 | Niemela et al. |
| 5,903,986 | A | 5/1999 | Parker |
| 6,019,544 | A | 2/2000 | Emerson et al. |
| 6,044,579 | A | 4/2000 | Hadler et al. |
| 6,085,445 | A | 7/2000 | Kanzler |
| 6,154,986 | A | 12/2000 | Hadler et al. |
| 6,240,660 | B1 | 6/2001 | Dugas |
| 6,523,620 | B1 | 2/2003 | Burson |
| 6,681,505 | B1 | 1/2004 | Wells |
| 6,748,678 | B1 | 6/2004 | Verseef |
| 6,751,894 | B1 | 6/2004 | Verseef |

FOREIGN PATENT DOCUMENTS

| | | |
|---|---|---|
| DE | 2617235 | 10/1977 |
| DE | 3928914 | 3/1991 |
| JP | 1190805 | 7/1989 |
| WO | WO 8901546 | 2/1989 |

GATE ASSEMBLY AND METHOD FOR A SNOW PLOW BLADE

BACKGROUND OF THE INVENTION

Snow plow blades are often provided with attachments intended to increase plowing efficiency and performance. For example, some attachments are gates attached to the snow plow blade and movable to control the movement of snow along the snow plow blade. Such gates can be used to block movement of snow past an end of the snow plow blade as the snow plow blade moves over a surface to be cleared.

Demand continues to increase for snow plow blades and blade attachments that are operable at higher speeds, can clear snow without multiple passes, can be adapted to different plowing environments, and are relatively easy to control. New snow plow blades and blade attachments offering any of these features would therefore be welcome in the art.

SUMMARY OF THE INVENTION

Some embodiments of the present invention provide a gate assembly for a snow plow blade having first and second opposite ends, wherein the gate assembly comprises a gate pivotably coupled to the first end of the snow plow blade, the gate pivotable from a deployed position in which the gate is adjacent the first end of the snow plow blade and has a surface positioned in a first substantially laterally-facing direction to block snow from exiting the first end of the snow plow blade, through an intermediate position in which the surface faces in a direction substantially opposite the first laterally-facing direction, and to a stowed position in which at least part of the gate is moved to a location behind the snow plow blade and between the first and second ends of the snow plow blade.

In some embodiments, a gate assembly for a snow plow blade is provided, and comprises a gate located proximate an end of the snow plow blade, the gate pivotable with respect to the snow plow blade from a deployed position in which the gate blocks snow from exiting the snow plow blade to a stowed position in which at least part of the gate is moved to a location behind the snow plow blade; and a hinge coupled to the gate and the snow plow blade, the gate pivotable between the deployed and stowed positions about an axis of the hinge, the axis of the hinge skewed in a generally upward and forward direction with respect to a direction of travel of the snow plow blade, wherein the gate is pivotable about the axis toward the deployed position in a generally forward and downward direction with respect to the direction of travel of the snow plow blade, and is pivotable about the axis toward the stowed position in a generally rearward and upward direction with respect to the direction of travel of the snow plow blade.

Some embodiments of the present invention provide a method of deploying a snow plow blade gate with respect to a snow plow blade having first and second opposite ends, wherein the method comprises pivoting the gate away from a stowed position at least partially behind the snow plow blade and between the first and second ends of the snow plow blade; pivoting the gate toward a deployed position; lowering a lower edge of the gate by pivoting the gate from the stowed position toward the deployed position; and pivoting the gate to the deployed position adjacent the first end of the snow plow blade in which the gate blocks snow from exiting the first end of the snow plow blade.

Further aspects of the present invention, together with the organization and operation thereof, will become apparent from the following detailed description of the invention when taken in conjunction with the accompanying drawings, wherein like elements have like numerals throughout the drawings.

Figure 1:
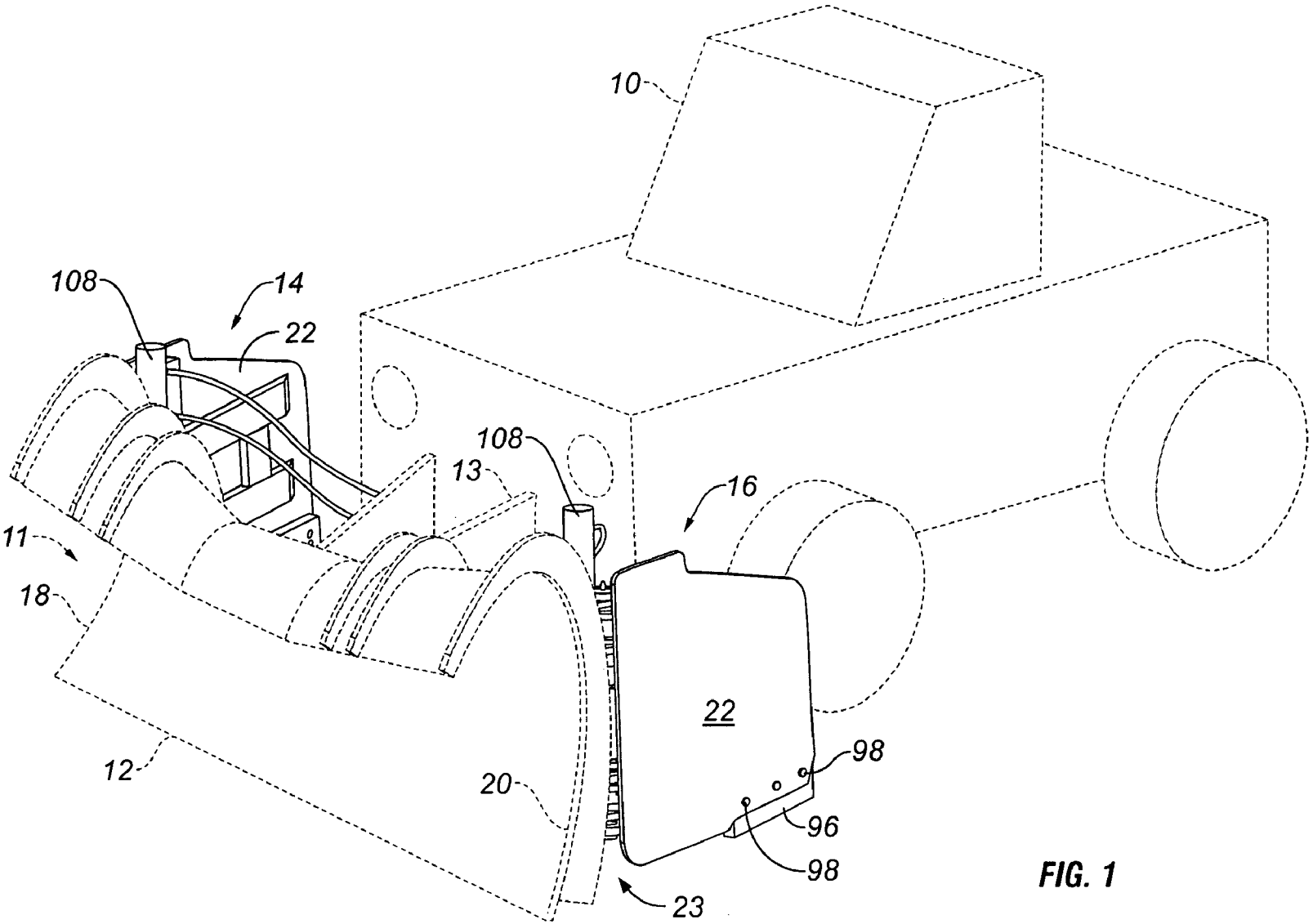
FIG. 1 is a front perspective view of a snow plow blade attached to a vehicle and having a snow plow blade gate assembly according to an embodiment of the present invention, wherein the snow plow blade gate is shown in a stowed position.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

Figure 9:
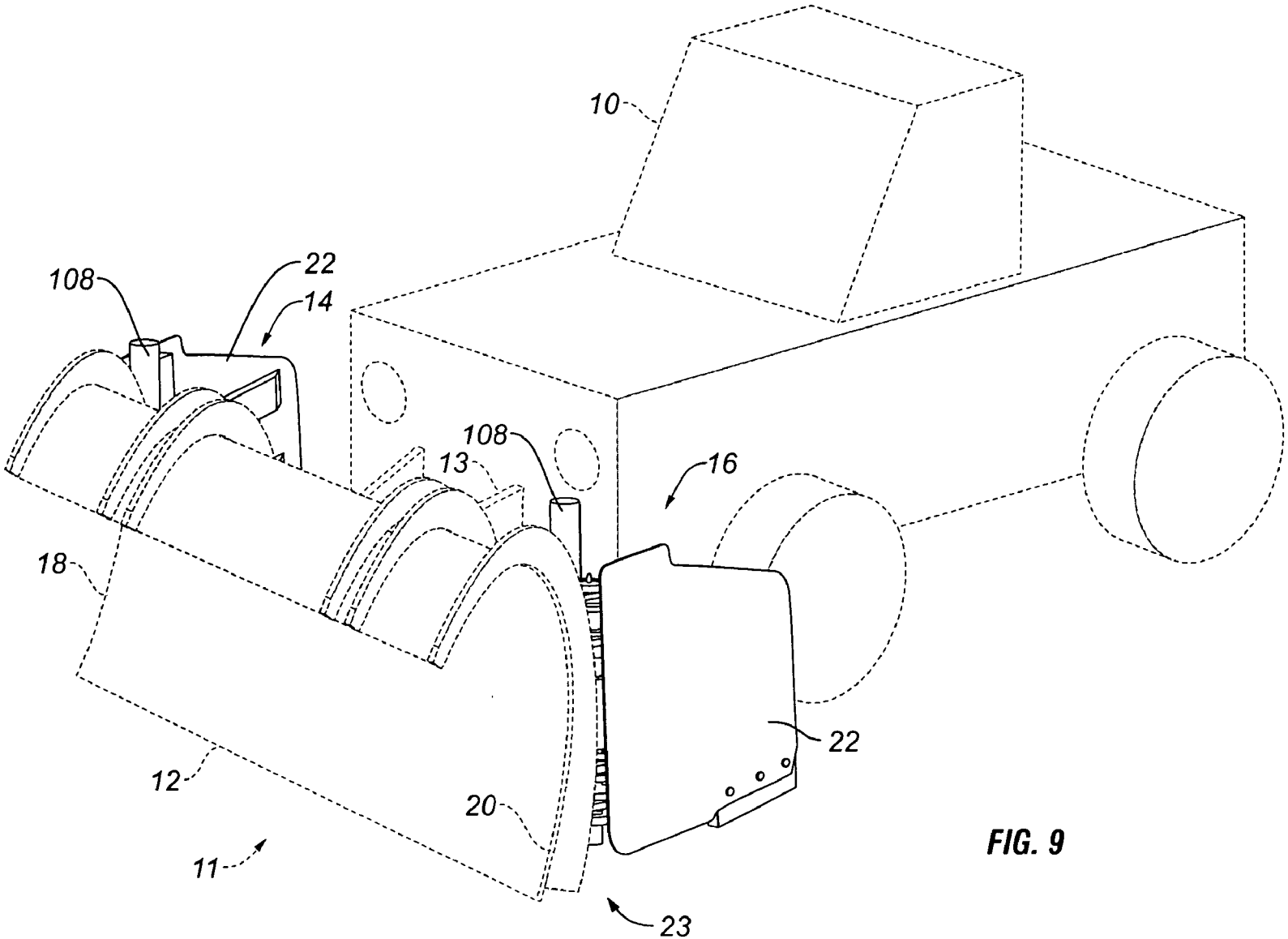
FIG. 9 is a front perspective view of a snow plow blade gate assembly according to the present invention, shown used with another type of snow plow blade.

FIGS. 1–4 illustrate a vehicle 10 having a snow plow (indicated generally at 11) attached thereto. The snow plow 11 includes a snow plow blade 12 and a frame 13 for mounting the snow plow blade 12 to the vehicle 10 in a conventional manner. The snow plow blade 12 illustrated in FIGS. 1–4 is a flared snow plow blade 12, although the gate assembly of the present invention (described below) can be coupled to any other type of snow plow blade. By way of example only, the gate assembly of the present invention can be coupled to and used with straight blades (see FIG. 9), V-Plow, K-Plow, and one-way blades, plow wings, folding wings, underbody and pork body scrapers, and the like, any of which can have one or more trip edges. Such blades and their manner of operation are well known to those skilled in the art and are not therefore described further herein.

Figure 2:
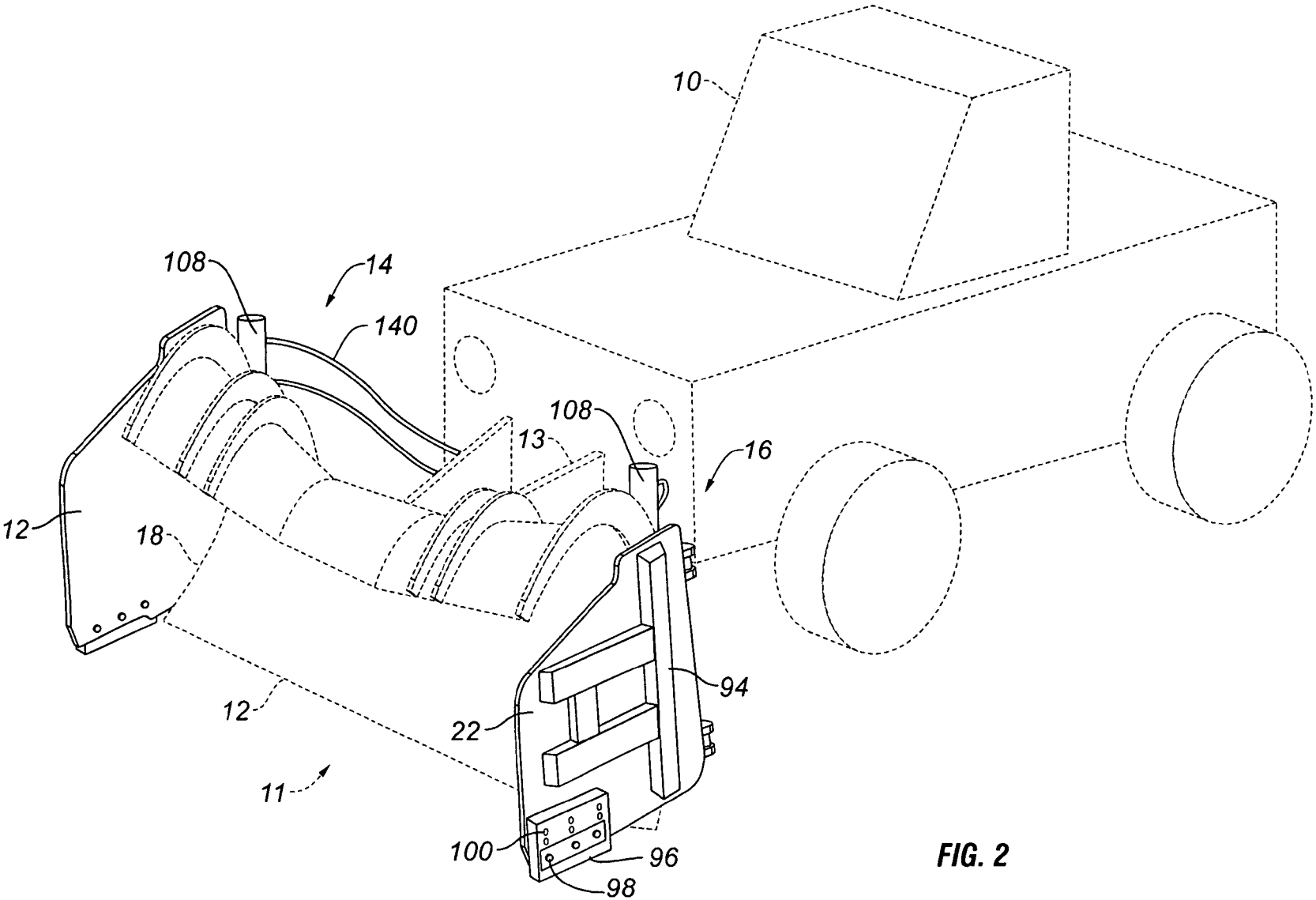
FIG. 2 is another front perspective view of the snow plow blade, vehicle, and snow plow blade gate assembly illustrated in FIG. 1, shown with the snow plow blade gate in a deployed position.

A gate assembly 14, 16 according to the present invention is located at each end 18, 20 of the snow plow blade 12 illustrated in FIGS. 1–4. However, in other configurations the snow plow blade 12 can instead have a single gate assembly 14, 16 located at one of the ends 18, 20 of the snow plow blade 12. For ease of description, only the driver's side gate assembly 16 will be described in greater detail herein. However, the description of the driver's side gate assembly 16 applies equally to the passenger side gate assembly 14, which is a mirror image of the driver's side gate assembly as shown in FIGS. 1 and 2.

With continued reference to FIGS. 1–4, the gate assembly 16 includes a gate 22 pivotably coupled to an end 20 of the snow plow blade 12. In this embodiment, the gate 22 is attached to the end 20 of the snow plow blade 12 by a hinge 23 having an upper hinge joint 24 and a lower hinge joint 26. In other embodiments, the hinge 23 has more hinge joints or can have a single hinge joint. In the illustrated embodiment of FIGS. 1–8, the upper hinge joint 24 includes a hinge pivot 28 received within apertures 30 in hinge plates 34 extending from the gate 22 and within apertures 38 in hinge plates 42 extending from the snow plow blade 12. Similarly, the lower hinge joint 26 includes a hinge pivot 46 received within apertures 48 in hinge plates 52 extending from the gate 22 and within apertures 56 in hinge plates 60 extending from the snow plow blade 12.

The hinge plates 34, 52 and 42, 60 can be integral with the gate 22 and snow plow blade 12, respectively, or can be coupled thereto in any manner, including without limitation by welding or brazing, by any number of bolts, screws, pin and aperture sets, rivets, and other conventional fasteners, by inter-engaging elements or features on the gate 22 and hinge plates 34, 52 and/or on the snow plow blade 12 and hinge plates 42, 60, and the like. In the illustrated embodiment, the hinge plates 34, 52 and 42, 60 are welded to the gate 22 and to a rear surface of the snow plow blade 12, respectively.

The hinge plates 42, 60 on the snow plow blade 12 in the illustrated embodiment of FIGS. 1–8 are substantially L-shaped, wherein one leg of each hinge plate 42, 60 is attached to the snow plow blade 12, and another leg of each hinge plate 42, 60 extends a distance from the snow plow blade 12 to a corresponding hinge pivots 28, 46. Also, each of the hinge plates 34, 52 on the gate 22 in the illustrated embodiment of FIGS. 1–8 extends in a fairly straight direction from the gate 22 to a corresponding hinge pivot 28, 46. In other embodiments, any or all of the hinge plates 34, 42, 52, 60 can have any other shape desired, including without limitation triangular shapes, rectangular shapes, irregular shapes, and the like.

In some embodiments, one or more hinge plates 34, 42, 52, 60 can be reinforced by one or more gussets, braces, or other reinforcing members. In the embodiment of FIGS. 1–8 by way of example only, the lower hinge plates 60 extending from the snow plow blade 12 are reinforced by gussets 64 extending between the lower snow plow blade hinge plates 60, and are welded to a rear surface of the snow plow blade 12 and to the lower snow plow blade hinge plates 60. If used, gussets 64, braces, or other reinforcing members can be attached to the snow plow blade 12 and/or to the gate 22 in any manner desired, including those described above with reference to the connection between the hinge plates 34, 42, 52, 60 and the snow plow blade 12 and gate 22.

In the illustrated embodiment of FIGS. 1–8, each hinge joint 24, 26 has a pair of hinge plates 42, 60 extending from the snow plow blade 12 and a pair of hinge plates 34, 52 extending from the gate 22. Each pair of hinge plates 34, 52 extending from the gate 22 is received between a pair of hinge plates 42, 60 extending from the snow plow blade 12, respectively. However, the hinge plates 34, 42 and 52, 60 of either or both hinge joints 24, 26 can be arranged in any other manner. For example, each pair of hinge plates 42, 60 extending from the snow plow blade 12 can instead be received between a pair of hinge plates 34, 52 extending from the gate 22. As another example, the hinge plates 34, 42 and 52, 60 of either or both hinge joints 24, 26 can alternate in position along the respective hinge joint 24, 26.

The use of two hinge plate pairs for each hinge joint 24, 26 as described above can provide improved hinge strength and stability. However, in other embodiments, either or both hinge joints 24, 26 can have different numbers of hinge plates, such as a pair of hinge plates for each hinge joint 24, 26, three or more hinge plates for each hinge joint 24, 26 (e.g., two hinge plates extending from the snow plow blade 12 and one hinge plate extending from the gate 22, or vice versa), and the like. Each hinge joint 24, 26 can have any number of hinge plates arranged in any manner while still falling within the spirit and scope of the present invention.

As described above, the upper hinge plates 34, 42 have apertures 30, 38 within which the hinge pivot 28 of the upper hinge joint 24 is received, and the lower hinge plates 52, 60 have apertures 48, 56 within which the hinge pivot 46 of the lower hinge joint 26 is received. In some embodiments, one or more of the apertures 30, 38, 48, 56 have a collar at least partially surrounding the aperture 30, 38, 48, 56, thereby defining a thicker and stronger portion of the hinge plate 34, 42, 52, 60 in which the hinge pivot 28, 46 is received. With reference to the illustrated embodiment of FIGS. 1–8 for example, each hinge plate 34, 52 of the gate 22 has a collar 66 welded thereto, and each hinge plate 42, 60 of the snow plow blade 12 has a collar 68 welded thereto. The collars 66, 68 can be secured to their respective hinge plates 34, 52 and 42, 60 in any manner, including any of the manners described above with reference to the connection between the hinge plates 34, 42, 52, 60 and the snow plow blade 12 and gate 22. Also, each collar 66, 68 can be attached to a face of a hinge plate 34, 42, 52, 60 about a hinge plate aperture 30, 38, 48, 56 or can be received and secured within a hinge plate aperture 30, 38, 48, 56 as shown in the illustrated embodiment of FIGS. 1–8.

The collars 66, 68 can have any length desired. For example, the collars 68 on the snow plow blade hinge plates 42, 60 in the illustrated embodiment of FIGS. 1–8 are shorter in length than the collars 66 on the gate hinge plates 34, 52. Also, a collar can be attached to two or more hinge plates, in some embodiments. For example, a single collar 66 is attached to and extends between each pair of gate hinge plates 34, 52 in the illustrated embodiment of FIGS. 1–8.

The hinge pivots 28, 46 pivotably couple the gate 22 to the snow plow blade 12 as described above. For this purpose, the hinge pivots 28, 46 can be pivotable with respect to the snow plow blade hinge plates 42, 60 (and collars 68, if used) and/or the gate hinge plates 34, 52 (and collars 66, if used). In the illustrated embodiment of FIGS. 1–8 for example, the upper hinge pivot 28 is pivotable with respect to the upper snow plow blade hinge plates 42, but is fixed against rotation with respect to the upper gate hinge plates 34. Similarly, the lower hinge pivot 46 is pivotable with respect to the lower snow plow blade hinge plates 60, but is fixed against rotation with respect to the lower gate hinge plates 52. In the illustrated embodiment of FIGS. 1–8, the hinge pivots 28, 46 are each fixed against rotation with respect to the upper and lower gate hinge plates 34, 52 by a cotter pin (not shown) received through apertures 78 in the collars 66 of the gate hinge plates 34, 52 and through apertures (not shown) in the hinge pivots 28, 46. However, the hinge pivots 28, 46 can be secured against rotation with respect to any of the hinge plates 34, 42, 52, 60 in any other manner, such as by a splined pivot connection between the hinge pivots 28, 46 and the hinge plates 34, 42, 52, 60 (and/or collars 66, 68, if used), by one or more setscrews, by welding or brazing, by an interference fit between the hinge pivots 28, 46 and the hinge plates 34, 42, 52, 60 (and/or collars 66, 68, if used), and the like. In some embodiments, either or both hinge pivots 28, 46 can be integral with one or more hinge plates 34, 42, 52, 60. Still other manners of securing either or both hinge pivots 28, 46 against rotation with respect to any of the hinge plates 34, 42, 52, 60 are possible in other embodiments of the present invention.

In some embodiments, either or both hinge pivots 28, 46 can be provided with conventional lubricant fittings 82 in order to reduce resistance to pivotal movement of the gate 22. Also, either or both pivots 28, 46 can be fitted with bearings for the same purpose, such as bearings received upon the pivots 28, 46 and within one or more of the hinge plate collars 66, 68 (if used). Any suitable bearing can be used, and falls within the spirit and scope of the present invention.

As described above, the gate assembly 16 illustrated in the embodiment of FIGS. 1–8 has two hinge joints 24, 26, each of which has a hinge pivot 28, 46 received within apertures 30, 38, 48, 56 in hinge plates 34, 42, 52, 60. In other embodiments, different types and numbers of hinge joints 24, 26 can be used to pivotably couple the gate 22 to the snow plow blade 12. For example, some embodiments of the present invention have only a single hinge joint 24, 26 pivotably coupling the gate 22 to the snow plow blade 12. In other embodiments, any number of additional hinge joints 24, 26 can be used. As another example, some embodiments of the present invention have a hinge pivot 28, 46 that is common to two or more hinge joints 24, 26, such as a single pivot 28, 46 received within the hinge plate apertures 30, 38, 48, 56 in both hinge joints 24, 26 illustrated in the embodiment of FIGS. 1–8. As yet another example, in some embodiments of the present invention, the hinge pivots 28, 46 are not received in apertures in hinge plates 34, 42, 52, 60 as described above. Instead, either or both hinge pivots 28, 46 are received within apertured bosses, flanges, or other features or elements on the snow plow blade 12 and/or the gate 22. Such bosses, flanges, or other features or elements can be integral with the snow plow blade 12 and/or the gate 22, or can be coupled thereto in any manner.

Figure 3:
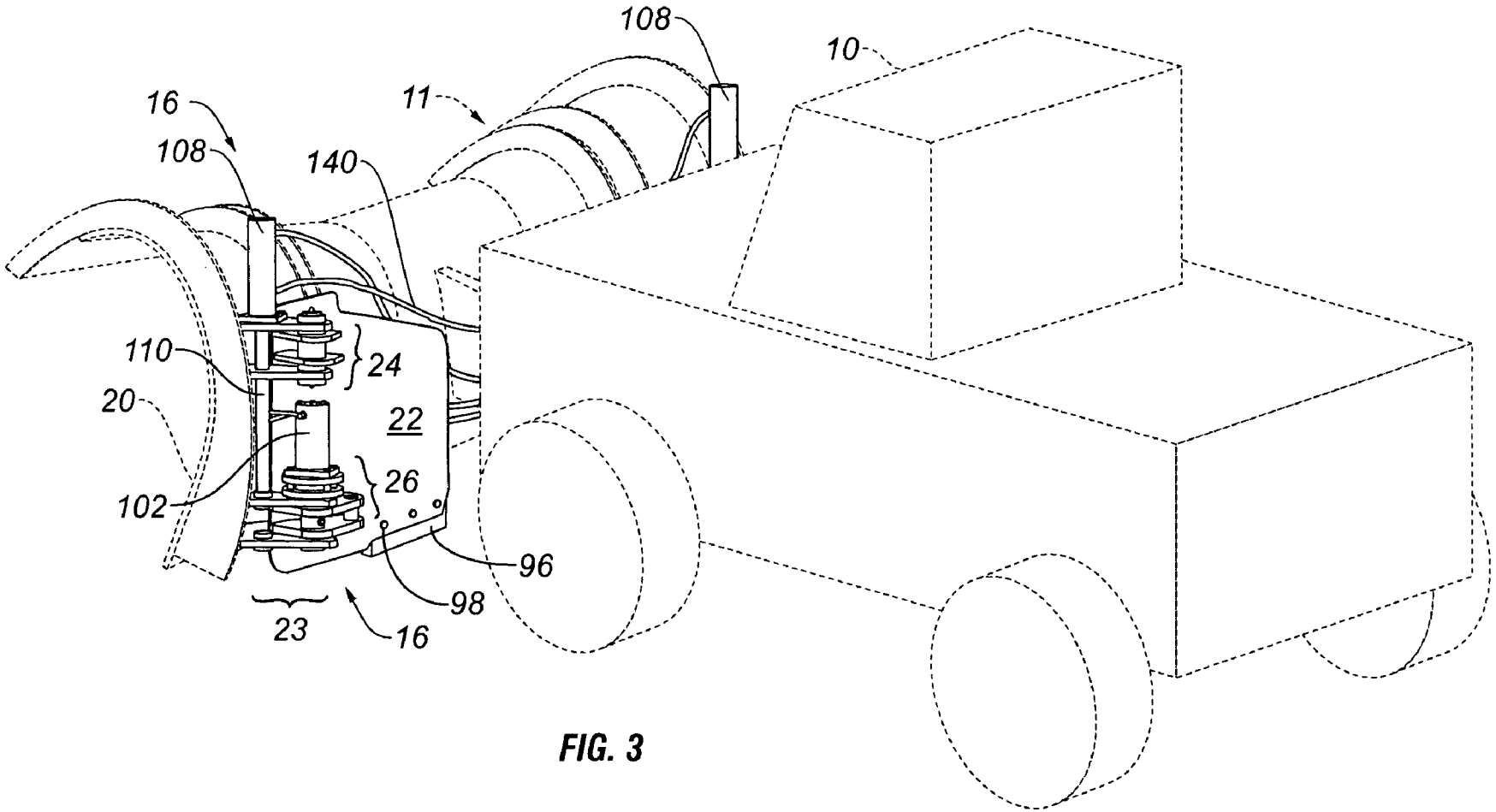
FIG. 3 is a rear perspective view of the snow plow blade gate assembly illustrated in FIGS. 1 and 2, shown attached to the snow plow blade illustrated in FIGS. 1 and 2 and with the snow plow blade gate in the stowed position.
Figure 4:
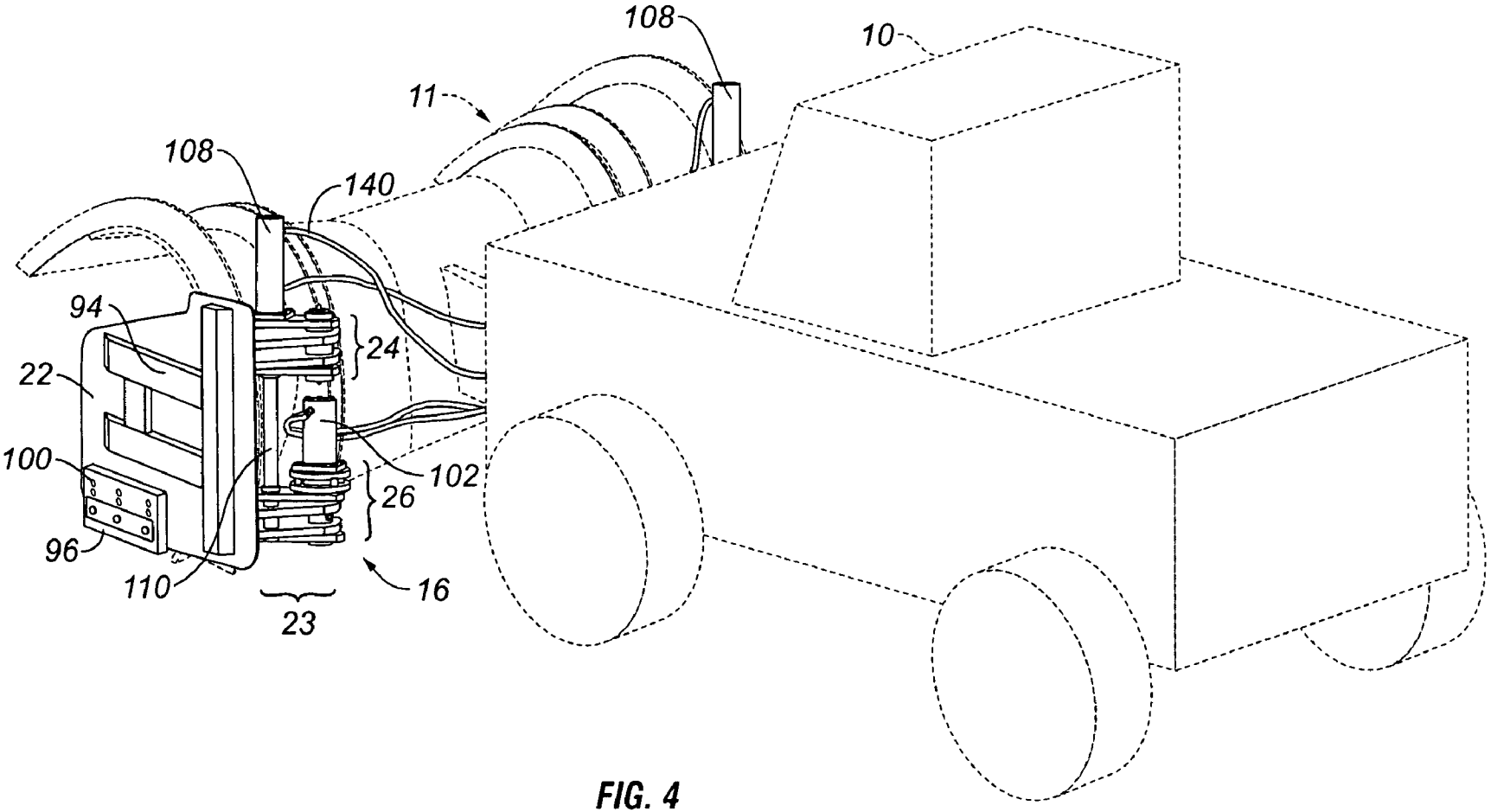
FIG. 4 is another rear perspective view of the snow plow blade gate assembly illustrated in FIGS. 1 and 2, shown attached to the snow plow blade illustrated in FIGS. 1 and 2 and with the snow plow blade gate in the deployed position.
Figure 5:
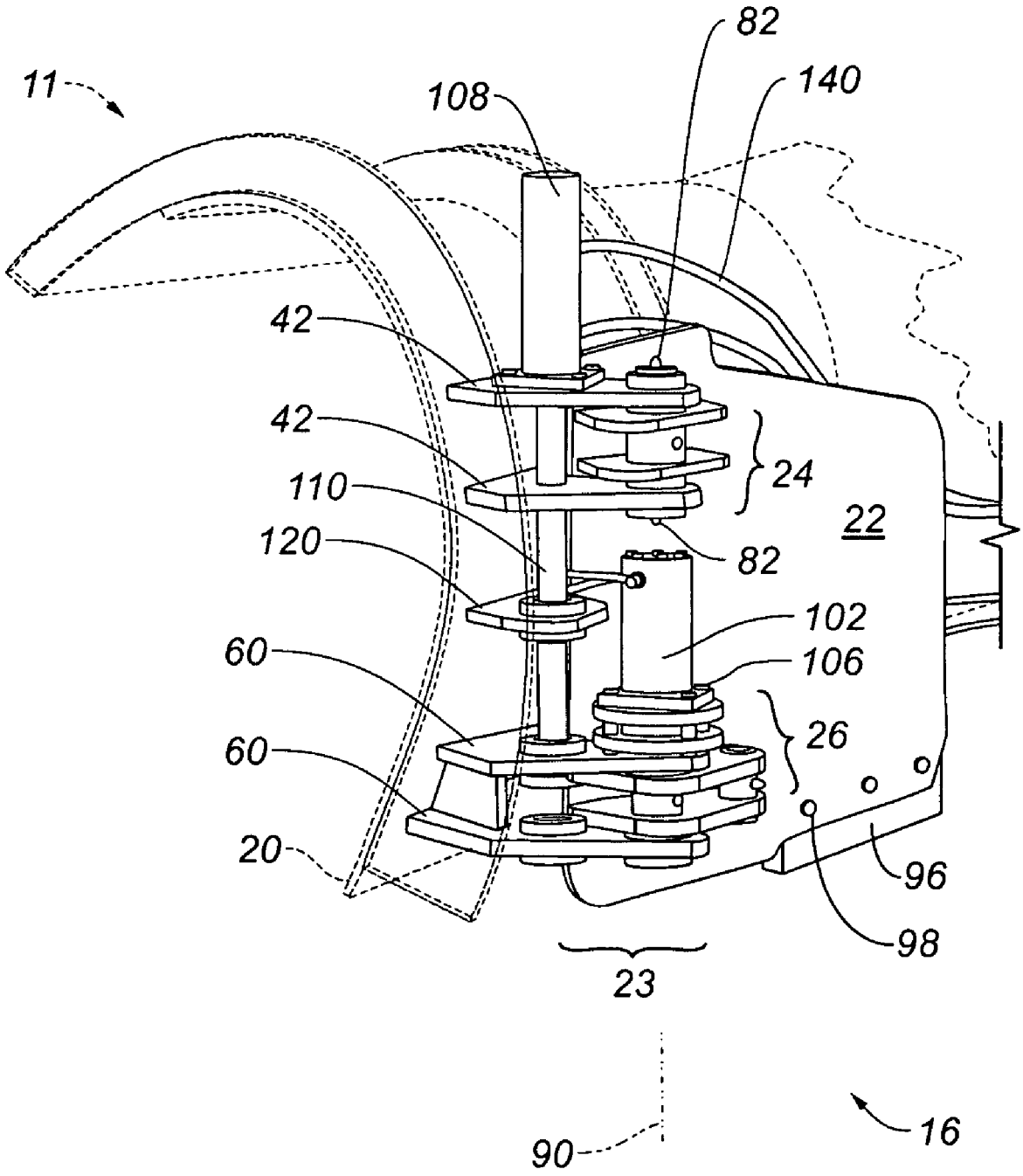
FIG. 5 is a perspective view of the snow plow blade gate assembly illustrated in FIGS. 1–4.
Figure 6:
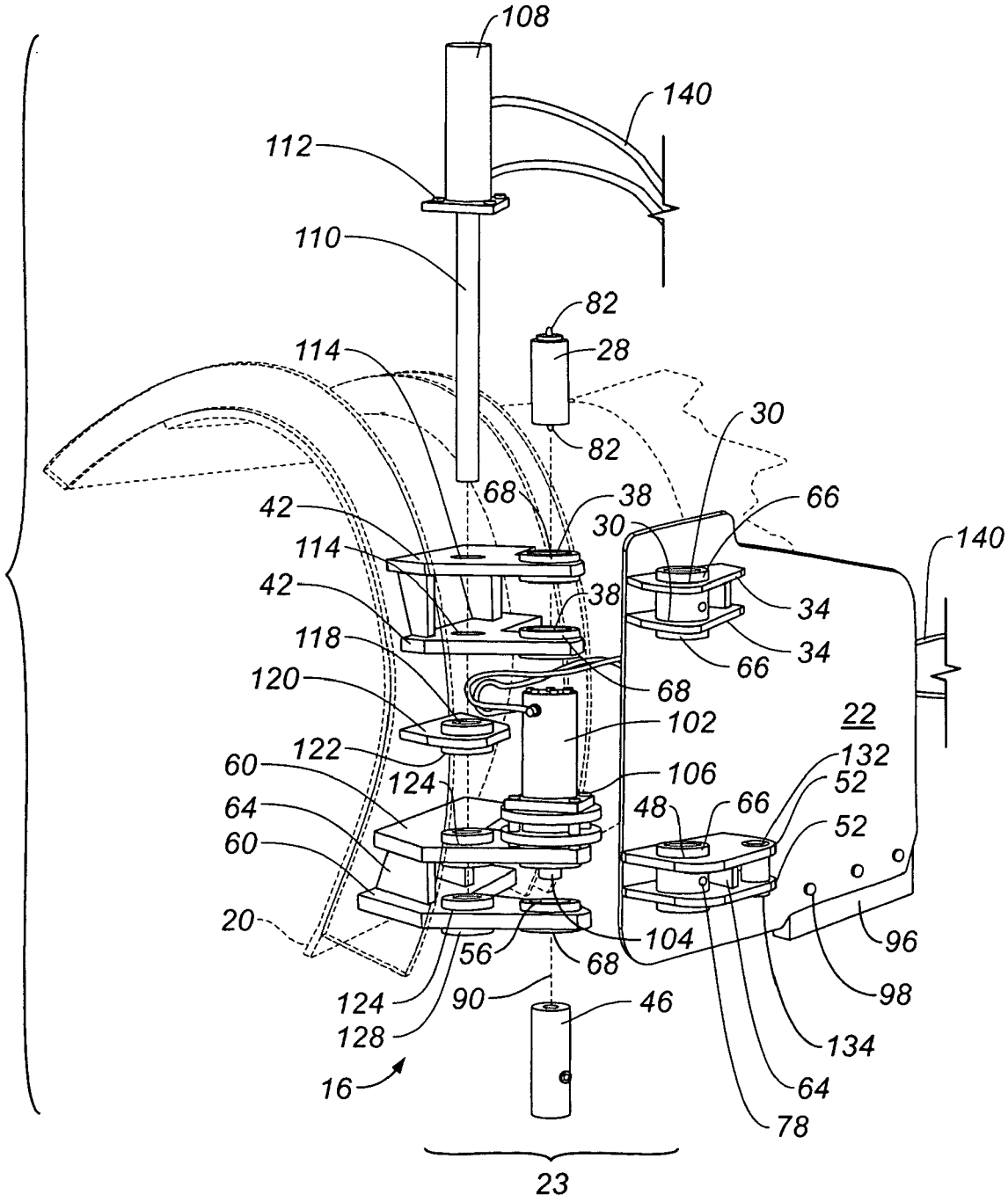
FIG. 6 is an exploded perspective view of the snow plow blade gate assembly illustrated in FIGS. 1–5.

With continued reference to the illustrated embodiment of FIGS. 1–8, the gate 22 of the gate assembly 16 is rotatable between a stowed position shown in FIGS. 1 and 3 and a deployed position shown in FIGS. 2 and 4. In the stowed position, at least a portion of the gate 22 is located behind the snow plow blade 12 and between the ends 18, 20 of the snow plow blade 12. In the illustrated embodiment of FIGS. 1–8, the entire gate 22 (and the other components of the gate assembly 16 described herein) is located behind the snow plow blade 12 and between the ends 18, 20 of the snow plow blade 12. In the deployed position, the gate 22 is positioned adjacent the end 20 of the snow plow blade 12 and is oriented in a generally forward direction (with respect to the travel direction of the snow plow blade 12). In this position, a face of the gate 22 faces substantially laterally with respect to the direction of motion of the snow plow blade 12 during operation. In some embodiments, the gate 22 abuts or is immediate adjacent the end 20 of the snow plow blade 12 when in the deployed position, thereby preventing snow from exiting the snow plow blade 12.

In some embodiments, a wear member 96 is attached to a bottom of the gate 22, and contacts the ground when the gate 22 is in a deployed position as described above. By engaging the ground during movement of the snow plow blade 12, the wear member 96 can help prevent snow from passing the gate 22 during operation of the snow plow 12.

The wear member 96 can be attached to the gate 22 by one or more fasteners (such as by bolts 98 received within apertures 100 in the wear member 96 and gate 22 as shown in the embodiment of FIGS. 1–8). In other embodiments, the wear member 96 can be releasably attached to the gate 22 in any other suitable manner, including the manners of connection described above with reference to the connection between the hinge plates 34, 42, 52, 60 and the snow plow blade 12 and gate 22. In some embodiments, the wear member 96 can be adjusted to different positions with respect to the gate 22, such as after the wear member 96 has been worn from operation. By way of example only, the apertures 100 in the wear member 96 shown in the embodiment of FIGS. 1–8 are elongated. Also, the wear member 96 and/or gate 22 can have multiple sets of apertures 100 for attachment of the wear member 96 to the gate 22 in different positions. Still other manners of adjusting the position of the wear member 96 are possible, and fall within the spirit and scope of the present invention.

To rotate between the deployed and stowed positions, in some embodiments the gate 22 rotates through at least about 180 degrees. Therefore, a face of the gate 22 faces substantially laterally when the gate 22 is in a deployed position, and is rotated to a position in which the same face faces laterally in an opposite direction when the gate 22 is rotated to or toward a stowed position. In the illustrated embodiment of FIGS. 1–8, the gate 22 rotates over 210 degrees between deployed and stowed positions. In this manner, the entire gate 22 is rotated to a location behind the snow plow blade 12 and between the ends 18, 20 of the snow plow blade 12. In this location, the snow plow blade 12 shields the entire gate assembly 16 (or substantially the entire gate assembly 16) from airflow passing beneath and beside the snow plow blade 12 and from snow and other obstructions passing the end 20 of the snow plow blade 12 during movement of the snow plow blade 12 in a forward direction.

Figure 7:
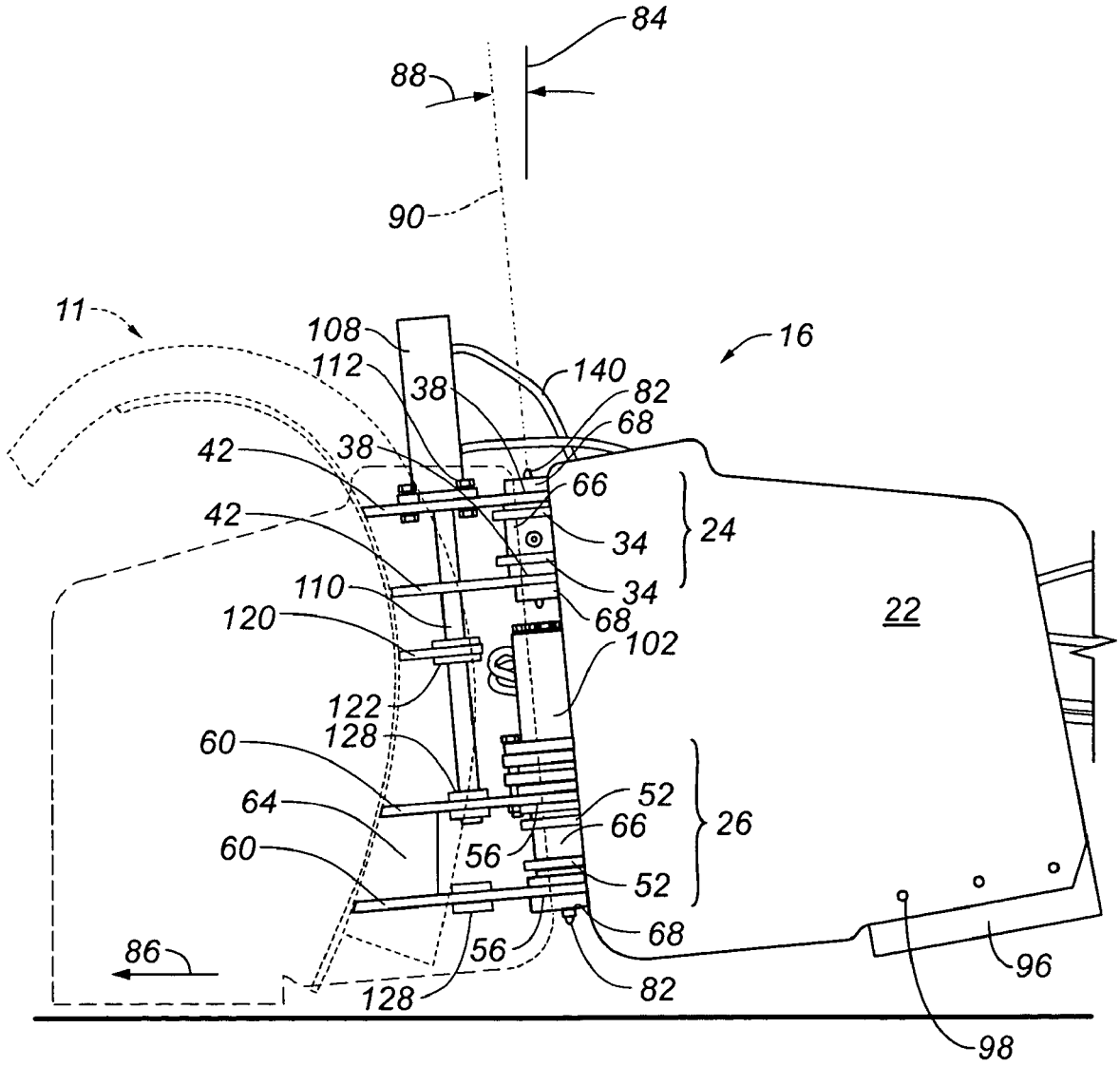
FIG. 7 is a side view of the snow plow blade gate assembly illustrated in FIGS. 1–6.

FIG. 7 illustrates the pivotal movement of the gate 22 shown in FIGS. 1–6. As shown in FIG. 7, the upper and lower hinge joints 24, 26 of the gate assembly 16 are not aligned with a vertical plane 84. Instead, the hinge pivots 28, 46 of the upper and lower hinge joints 24, 26 are oriented at an angle 88 with respect to the vertical plane 84. In some embodiments, the vertical plane 84 is defined as a plane that is substantially orthogonal to the forward direction of motion of the snow plow blade 12 (indicated by arrow 86 in FIG. 7). Described in another manner, the upper and lower hinge joints 24, 26 are oriented so that the gate 22 pivots about an axis of rotation 90 that is skewed by an angle 88 with respect to a vertical plane 84.

The inventors have discovered that an angle 88 greater than 0 degrees and less than about 10 degrees provides sufficient lift for the gate 22 while maintaining the gate 22 in a relatively low position with respect to the snow plow blade 12 when the gate 22 is in a stowed position. In the illustrated embodiment of FIGS. 1–8 for example, the angle 88 is about 5 degrees. Accordingly, the hinge plate apertures 38 in the upper snow plow blade hinge plates 42 are located forward of the hinge plate apertures 56 in the lower snow plow blade hinge plates 60. Similarly, the hinge plate apertures 30 in the upper gate hinge plates 34 are located forward of the hinge plate apertures 48 in the lower gate hinge plates 52.

Therefore, in some embodiments of the present invention, as the gate 22 rotates from a deployed position to a stowed position (as described above), the gate 22 is lifted. Similarly, the gate 22 is lowered as the gate 22 rotates from a stowed position to a deployed position. This lifting and lowering motion can take place through any amount of rotation of the gate 22. In the illustrated embodiment of FIGS. 1–8, the gate 22 is lifted from the deployed position for approximately 180 degrees of rotation toward the stowed position. The amount of lift provided to the gate 22 is at least partially dependent upon the relative positions of the upper and lower hinge joints 24, 26 as described above. In some embodiments, larger horizontal distances between the upper and lower hinge joints 24, 26 result in larger amounts of lift for the gate 22, while smaller distances between the upper and lower hinge joints 24, 26 result in smaller amounts of lift for the gate 22.

The lifting motion generated by rotating the gate 22 illustrated in FIG. 7 toward a stowed position enables the gate 22 to be positioned a distance over the ground adjacent the snow plow blade 12 when the gate 22 is not in use. As a result, the gate 22 is less likely to interfere with snow and other obstacles passing beside and beneath the snow plow blade 12 during movement of the snow plow blade 12 in a forward direction 86, and is shielded from airflow passing beneath and beside the blade 12. The lowering motion generated by rotating the gate 22 illustrated in FIG. 7 toward a deployed position enables the gate 22 to be positioned closer to the ground (and in some cases, in position to contact the ground) when the gate 22 is in use.

In some embodiments, the gate 22 is located in a lowermost position when the gate 22 is in a forward deployed position, and is in an uppermost position when the gate 22 is in a rear stowed position. However, in other embodiments, the lowermost position of the gate 22 can be in other rotational positions of the gate 22, and the uppermost position of the gate 22 can be in other rotational positions of the gate 22. The positional relationship between the upper and lower hinge joints 24, 26 at least partially determines the height of the gate 22 at different rotational positions of the gate 22. For example, in some embodiments, the gate 22 can be at a lowermost position when the gate 22 is rotated so that a face of the gate 22 substantially faces in the direction of motion 86 of the snow plow blade 12. Such gate movement can be generated by positioning the lower hinge joint 26 laterally inboard (toward the center of the snow plow blade 12) of the upper hinge joint 24. As another example, in some embodiments, the gate 22 is at an uppermost position when the gate 22 is rotated so that a face of the gate 22 substantially faces in the direction of motion 86 of the snow plow blade 12. Such gate movement can be generated by positioning the lower hinge joint 26 laterally outboard (away from the center of the snow plow blade 12) of the upper hinge joint 24.

It will be appreciated that the rotational position of the lowest and highest gate positions can be selected by selecting the horizontal position of the upper hinge joint 24 relative to the lower hinge joint 26. It will also be appreciated that the ranges of gate rotation providing gate lift and gate lowering can also be selected by selecting the horizontal position of the upper hinge joint 24 relative to the lower hinge joint 26. Such relative positions of the upper and lower hinge joints 24, 26 are therefore selected to generate the desired gate motion and the desired positions of the gate 22 when deployed and stowed.

The gate 22 can have any shape desired, and in some embodiments is shaped to cover an end 18, 20 of the snow plow blade 12 when the gate 22 is in a deployed position as described above. In some embodiments, the gate 22 has one or more reinforcing members 94 coupled to or integral with the gate 22. Reinforcing members 94 can be used to stiffen and/or strengthen the gate 22. In the illustrated embodiment of FIGS. 1–8, the reinforcing members 94 are channels coupled to a side of the gate 22 facing in a laterally outboard direction when the gate 22 is in the deployed position described above. In other embodiments, the reinforcing members 94 can be one or more rods, bars, tubes, or other members coupled to either or both sides of the gate 22. The reinforcing member(s) 94 can be coupled to the gate 22 by welding. However, in other embodiments, the reinforcing member(s) 94 are coupled to the gate 22 in any of the manners described above with reference to the connection between the hinge plates 34, 42, 52, 60 and the snow plow blade 12 and gate 22. As mentioned above, the reinforcing member(s) 94 can be integral with the gate 22. For example, reinforcing members 94 can be stamped, pressed, embossed, molded, or otherwise formed in one or more portions of the gate 22.

With reference now to FIGS. 5–8, some embodiments of the present invention have a gate assembly 16 powered by an actuator. The actuator in the illustrated embodiment of FIGS. 1–8 is a hydraulic motor 102, although any type of driving device can instead be used in other embodiments. The hydraulic motor 102 is drivably coupled to the lower hinge pivot 46 by a motor shaft 104 extending into engagement with an aperture in the lower hinge pivot 46. This engagement can be a keyed, splined, interference fit, or other engagement well known to those skilled in the art. Also, the hydraulic motor 102 can be drivably coupled to the lower hinge pivot 46 in any other manner. By driving the lower hinge pivot 46, the hydraulic motor 102 can rotate the gate 22 between the deployed and stowed positions described above.

The hydraulic motor 102 in the embodiment of FIGS. 1–8 is mounted to and is supported by a snow plow blade hinge plate 60 of the lower hinge joint 26. The hydraulic motor 102 is mounted by one or more bolts 106, although the hydraulic motor 102 can instead be permanently or releasably mounted in any other manner known to those skilled in the art. For example, the hydraulic motor 102 can be mounted in any of the manners described above with reference to the connection between the hinge plates 34, 42, 52, 60 and the snow plow blade 12 and gate 22.

In alternative embodiments of the present invention, the hydraulic motor 102 can instead be drivably coupled to the upper hinge pivot 28 in any of the manners described above with reference to the connection between the hydraulic motor 102 and the lower hinge pivot 46. In such cases, the hydraulic motor 102 can be mounted as described above to a snow plow blade hinge plate 42 of the upper hinge joint 24.

Depending at least in part upon the size of the hydraulic motor 102 and the location of the hinge pivot 28, 46 driven by the hydraulic motor 102, the hydraulic motor 102 can be mounted to the gate 22, the snow plow blade 12, or to any part of the hinge joints 24, 26. Still other locations of the hydraulic motor 102 are possible by drivably coupling the hydraulic motor 102 to either hinge pivot 28, 46 by sprockets and chains, by one or more gear sets, or by other power transmission assemblies. For example, the hydraulic motor 102 can be located inboard from the end 20 of the snow plow blade 12 and can be drivably coupled to either hinge pivot 28, 46 by a chain passed about sprockets on an output shaft of the hydraulic motor 102 and the pivot 28, 46. Still other manners of coupling the hydraulic motor 102 to rotate the gate 22 are possible, and fall within the spirit and scope of the present invention.

Although the gate 22 in the illustrated embodiment of FIGS. 1–8 is driven by a hydraulic motor 102 as described above, in other embodiments the gate 22 can be driven by any other type of actuator. For example, an electric motor can be used to drive the gate 22 between deployed and stowed positions. As another example, one or more hydraulic or pneumatic cylinders coupled to the gate 22 and/or to either hinge joint 24, 26 can be used to move the gate 22.

Some embodiments of the present invention have an actuator that can be actuated to releasably secure the gate 22 in one or more positions or to selectively limit rotation of the gate in one or more rotational directions. In the illustrated embodiment of FIGS. 1–8 for example, a hydraulic cylinder 108 is positioned to extend and retract a rod 110 to releasably secure the gate 22 in a deployed position. Hydraulic cylinders and their manner of operation are well known to those skilled in the art, and will not therefore be described further herein.

The hydraulic cylinder 108 in the illustrated embodiment of FIGS. 1–8 is mounted to the upper snow plow blade hinge plate 42 of the upper hinge joint 24 by one or more bolts 112. Alternatively, the hydraulic cylinder 108 can be mounted in any other manner known to those skilled in the art. For example, the hydraulic cylinder 108 can be mounted in any of the manners described above with reference to the manner in which the hydraulic motor 102 is mounted in the gate assembly 16.

The rod 110 extending from the hydraulic cylinder 108 passes through apertures 114 in the upper snow plow blade hinge plates 42 and through an aperture 118 in a guide plate 120 extending from the snow plow blade 12. The guide plate 120 can take any of the forms and can be coupled to the snow plow blade 12 in any of the manners described above with reference to the snow plow blade hinge plates 42, 60 and their relationship to the snow plow blade 12. In some embodiments, one or more of the apertures 114, 118 can have collars similar to those on the hinge plates 34, 42, 52, 60 as described above. In the illustrated embodiment of FIGS. 1–8, for example, the aperture 118 in the guide plate 120 has a collar 122 secured therein by welds.

As mentioned above, the hydraulic cylinder 108 can be actuated to extend and retract the rod 110. When extended, the rod 110 extends through apertures 124 in the snow plow blade hinge plates 60 of the lower hinge joint 26. In some embodiments, either or both apertures 124 have collars similar to those on the hinge plates 34, 42, 52, 60 as described above. In the illustrated embodiment of FIGS. 1–8, for example, the apertures 124 in the snow plow blade hinge plates 60 of the lower hinge joint 26 each have a collar 128 secured therein by welds.

In some embodiments, either or both gate hinge plates 52 of the lower hinge joint 26 have apertures through which the rod 110 can be passed when extended by the hydraulic cylinder 108. In the illustrated embodiment of FIGS. 1–8 for example, the gate hinge plates 52 each have an aperture 132 for receiving the rod 110. Either or both apertures 132 can have a collar similar to those of the hinge plates 34, 42, 52, 60 described above. In the illustrated embodiment of FIGS. 1–8, a single collar 134 extends between the gate hinge plates 52 of the lower hinge joint 26 and through both apertures 132 therein.

The apertures 132 are positioned in the lower gate hinge plates 52 so that the rod 110 can be inserted in the apertures 132 when the gate 22 is in a deployed position as described above. In this manner, the rod 110 can be extended to secure the gate 22 in the deployed position. In order to release the gate 22 from the deployed position, the hydraulic cylinder 108 is actuated to retract the rod 110 from the apertures 132 in the gate hinge plates 52 of the lower hinge joint 26. The rod 110 can have any shape capable of insertion into the apertures 132 and removal from the apertures 132, and in some embodiments has a rounded and/or tapered end to promote rod insertion.

In the illustrated embodiment of FIGS. 1–8, the rod 110 extends through apertures 114, 118, 124 in the lower snow plow blade hinge plates 52 and the guide plate 120. However, in other embodiments, the rod 110 extends in a different manner into and out of locking engagement with one or more hinge joints 24, 26. For example, the rod 110 need not necessarily pass through an aperture 118 in a guide plate 120 as described above. Alternatively, any number of additional apertured guide plates 120 can be used in other embodiments. As another example, the rod 110 need not necessarily pass through apertures 114, 124 in the snow plow hinge plates 52 as described above. Depending at least partially upon the size of the hydraulic cylinder 108 and the location(s) of the hinge joint(s) 24, 26, the hydraulic cylinder 108 can be mounted in the gate assembly 16 so that the rod 110 passes through fewer apertures in the snow plow hinge plates 52. For example, in some embodiments the rod 110 passes through only one of the apertures 124 in the lower snow plow blade hinge plates 52 (e.g., from beneath or from above the lower hinge joint 26).

The rod 110 can be extended and retracted to secure the gate 22 in still other manners, some preventing rotation of the gate 22 in either direction, and others limiting the range of rotation of the gate 22 and/or preventing rotation of the gate 22 in only one direction. In some embodiments, the rod 110 secures one or more of the gate hinge plates 34, 52 against rotation by releasably engaging one or more elements or features of the gate hinge plate(s) 34, 52. In the illustrated embodiment of FIGS. 1–8, the element or feature is a pair of apertures 132 in the gate hinge plates 52 of the lower hinge joint 26 as described above. However, such apertures can be located in any other part of the lower and/or upper hinge joints 26, 24, and can also be located in another part of the gate 22. The rod 110 can be extended into engagement with one or more of such apertures to lock the gate 22 in the deployed position.

In other embodiments, the rod 110 is extended to lock the gate 22 in other manners, such as by interfering in any other manner with the ability of the gate 22 to rotate. For example, the rod 110 can extend to a position beside one or more gate hinge plates 34, 52 so that an edge or other surface of the gate hinge plate(s) 34, 52 is blocked by the rod 110 from movement away from a rotational position. Alternatively, the rod 110 can extend to a position with respect to a projection on one or more of the gate hinge plates 34, 52 so that the projection is blocked by the rod 110, thereby blocking movement of the gate 22 away from a rotational position. As yet another example, the rod 110 can extend to a position in which the rod 110 blocks rotation of an arm or other element extending radially from a hinge pivot 28, 46 of a hinge joint 24, 26. Still other manners of releasably securing the gate 22 against rotation or of limiting the range of rotation of the gate 22 using the extendible and retractable rod 110 are possible, and fall within the spirit and scope of the present invention.

In some embodiments, the gate 22 can be secured against rotation in more than one rotational position of the gate 22. In the illustrated embodiment of FIGS. 1–8 for example, the rod 110 can be extended into engagement with the apertures 132 in the gate hinge plates 52 of the lower hinge joint 26 when the gate 22 is in a deployed position, and can be extended into engagement with another pair of apertures (not shown) in the same plates 52 when the gate 22 is in any other position. The additional apertures can be positioned in the lower gate hinge plates 52 so that the rod 110 can be inserted in the additional apertures when the gate 22 is in any other rotational position (such as a stowed position or a position between deployed and stowed positions). Any number of additional apertures can be provided to releasably secure the gate 22 in any number of desired rotational positions.

As described above, the rod 110 can be extended to releasably secure the gate 22 against rotation or to limit rotation of the gate 22. The rod 110 can be extended into engagement or interfering relationship with a number of different elements and features of the gate 22 in order to perform this function. Accordingly, the hydraulic cylinder 108 can be mounted in any manner to enable the rod 110 to be extended into engagement or interfering relationship with such elements and features. For example, the hydraulic cylinder 108 can be mounted to any of the snow plow blade hinge plates 42, 60 or the gate hinge plates 34, 52 (in which case the hydraulic cylinder 108 can move with the gate 22 and can extend the rod 110 into releasable engagement with an element or feature of the snow plow blade hinge plates 42, 60 or the snow plow blade 12). As another example, the hydraulic cylinder 108 can be mounted to the snow plow blade 12 or to the gate 22 in any manner, such as by a mounting plate or bracket on the snow plow blade 12 or gate 22, by mounting apertures in the snow plow blade 12 or gate 22, and the like.

The actuator used to releasably secure the gate 22 against rotation in the embodiment of FIGS. 1–8 is a hydraulic cylinder 108 and a rod 110. However, in other embodiments, other types of actuators can be used to perform the same or similar functions (including the rotation limiting functions described above). For example, the hydraulic cylinder 108 and rod 110 can be replaced by a pneumatic cylinder and rod assembly, a solenoid and armature assembly, a motor turning a worm screw axially extending and retracting a rod coupled thereto, a toothed rod meshing with a motor-driven gear to drive the rod in a manner similar to a rack and pinion assembly, and the like. Also, the actuator used to prevent or limit rotation of the gate 22 need not necessarily translate a rod or other locking element. In other embodiments, the actuator can rotate the locking element to and from a position in which the locking element prevents or limits rotation of the gate 22, or can actuate the locking element with any combination of linear and rotational motion.

Figure 8:
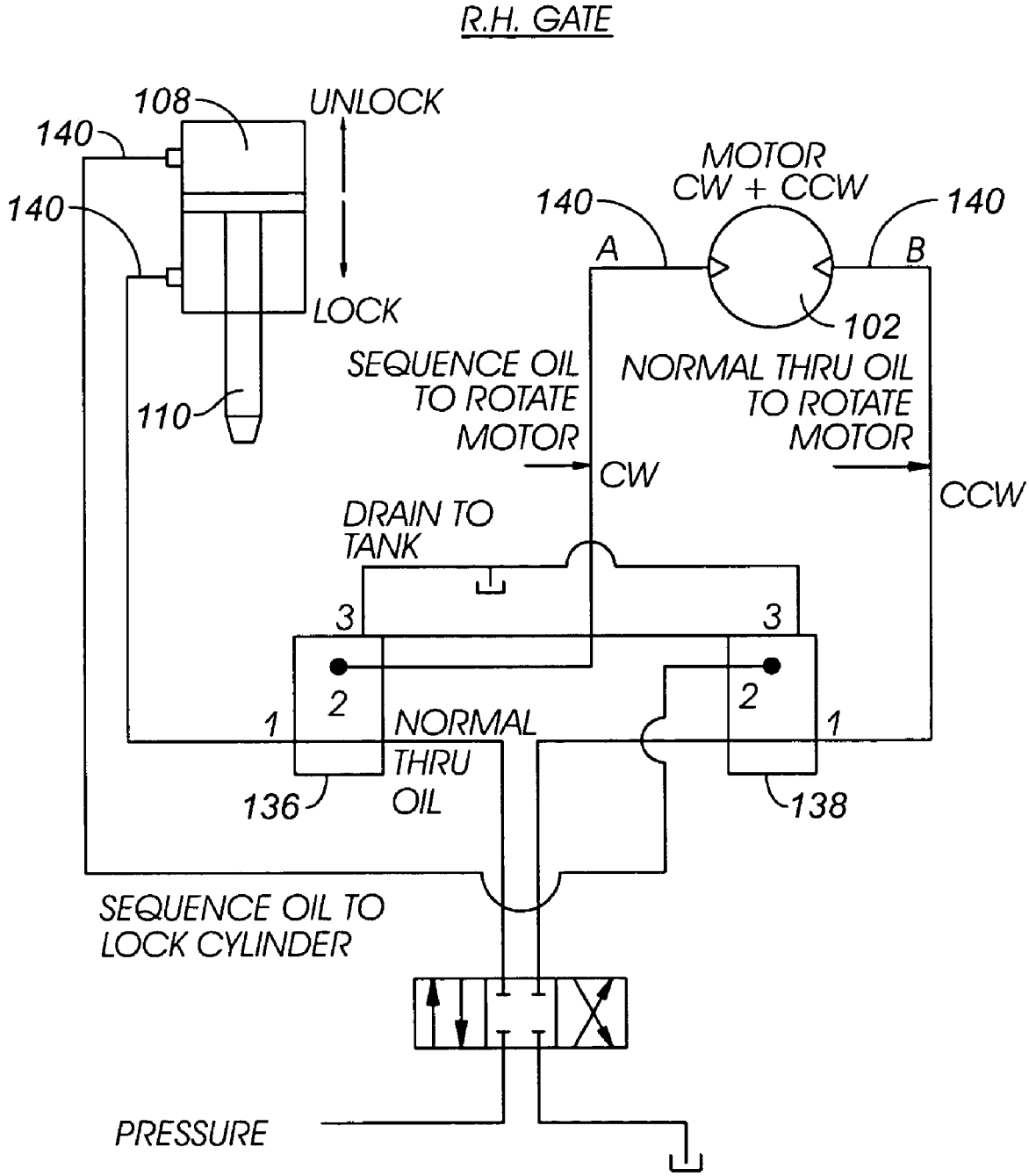
FIG. 8 is a schematic diagram of the hydraulic system of the snow plow blade gate assembly illustrated in FIGS. 1–7.

In some embodiments, the actuator used to prevent or limit rotation of the gate 22 is controlled in conjunction with the actuator used to rotate the gate 22. With reference to FIG. 8, for example, the hydraulic system in the embodiment of FIGS. 1–8 includes two sequence valves 136, 138 coupled via hydraulic lines 140 to the hydraulic motor 102 and hydraulic cylinder 108. Using sequence valves 136, 138 coupled as shown, the hydraulic cylinder 108 can be automatically actuated to extend the rod 110 when the gate 22 reaches the deployed position illustrated in FIGS. 2 and 4, thereby securing the gate 22 in the deployed position. The hydraulic cylinder 108 can also be automatically actuated to retract the rod 110 when the hydraulic motor 102 is driven to rotate the gate 22 from the deployed position. In other embodiments, sequence valves can be used in a similar manner to automatically actuate the hydraulic cylinder 108 to extend and/or retract the rod 110 in any other rotational position of the gate 22 (e.g., in a stowed position of the gate 22) or in two or more rotational positions of the gate 22.

As mentioned above, other embodiments of the present invention can use other types of actuators to rotate the gate 22 and/or to prevent or limit gate rotation. In such embodiments, these actuators can be controlled in a manner similar to that described above with reference to the hydraulic system illustrated in FIG. 8. For example, in embodiments using an electric motor to rotate the gate 22 and a solenoid to drive a rod into locking and unlocking positions with respect to the gate 22, the electric motor and solenoid can be coupled to a controller. The controller can coordinate actuation of the motor and solenoid in a manner similar to that described above with reference to actuation of the rod 110 and gate 22 in the embodiment of FIGS. 1–8. In other embodiments of the present invention, other types of actuator control are possible to perform the same or similar functions described above, and fall within the spirit and scope of the present invention.

Various alternatives and embodiments are contemplated as being within the scope of the following claims particularly pointing out and distinctly claiming the subject matter regarded as the invention. For example, although various examples of hinges are disclosed herein, it will be appreciated that a number of other hinge types can be used to pivotably couple a gate 22 to an end 18, 20 of a snow plow blade 12, all of which fall within the spirit and scope of the present invention.

What is claimed is:

1. A gate assembly for a snow plow blade having first and second opposite ends, the gate assembly comprising:

a gate pivotably coupled to the first end of the snow plow blade, the gate pivotable from a deployed position in which the gate is adjacent the first end of the snow plow blade and has a surface positioned in a first substantially laterally-facing direction to block snow from exiting the first end of the snow plow blade; through an intermediate position in which the surface faces in a direction substantially opposite the first laterally-facing direction; and to a stowed position in which at least part of the gate is moved to a location behind the snow plow blade and between the first and second ends of the snow plow blade;

the gate assembly further comprising an actuator having a first state in which the actuator secures the gate in the deployed position and a second state in which the gate is pivotable to the stowed position; and wherein the actuator is automatically actuated responsive to the gate reaching the deployed position.

2. The gate assembly as claimed in claim 1, wherein the actuator includes a telescoping rod and cylinder; and the rod is movable into and out of engagement with the gate.

3. The gate assembly as claimed in claim 2, wherein the actuator is located proximate the first end of the snow plow blade.

4. The gate assembly as claimed in claim 2, wherein the rod is removably received within an aperture in the gate to secure the gate in the deployed position.

5. The gate assembly as claimed in claim 1, further comprising a motor drivably coupled to the gate, wherein the gate is driven between the deployed and stowed positions by the motor.

6. The gate assembly as claimed in claim 5, further comprising a sequence valve coupled to the actuator and motor, the sequence valve triggering actuation of the actuator responsive to the gate reaching the deployed position.

7. A gate assembly for a snow plow blade having first and second opposite ends, the gate assembly comprising:

a gate pivotably coupled to the first end of the snow plow blade, the gate pivotable about an axis skewed with respect to a substantially vertical plane, the gate pivotable from a deployed position in which the gate is adjacent the first end of the snow plow blade and has a surface positioned in a first substantially laterally-facing direction to block snow from exiting the first end of the snow plow blade; through an intermediate position in which the surface faces in a direction substantially opposite the first laterally-facing direction; and to a stowed position in which at least part of the gate is moved to a location behind the snow plow blade and between the first and second ends of the snow plow blade.

8. A gate assembly for a snow plow blade having first and second opposite ends, the gate assembly comprising:

a gate pivotably coupled to the first end of the snow plow blade, the gate pivotable from a deployed position in which the gate is adjacent the first end of the snow plow blade and has a surface positioned in a first substantially laterally-facing direction to block snow from exiting the first end of the snow plow blade; through an intermediate position in which the surface faces in a direction substantially opposite the first laterally-facing direction; and to a stowed position in which at least part of the gate is moved to a location behind the snow plow blade and between the first and second ends of the snow plow blade, wherein the gate is a first gate, the gate assembly further comprising a second gate pivotably coupled to the second end of the snow plow blade, the second gate pivotable from a deployed position in which the second gate is adjacent the second end of the snow plow blade and has a surface positioned in a second substantially laterally-facing direction to block snow from exiting the second end of the snow plow blade; through an intermediate position in which the surface faces in a direction substantially opposite the second laterally-facing direction; and to a stowed position in which at least part of the gate is moved to a location behind the snow plow blade and between the first and second ends of the snow plow blade.

9. The gate assembly as claimed in claim 8, wherein the second gate is movable independently of the first gate.

10. A gate assembly for a snow plow blade, the gate assembly comprising:

a gate located proximate an end of the snow plow blade, the gate pivotable with respect to the snow plow blade from a deployed position in which the gate blocks snow from exiting the snow plow blade to a stowed position in which at least part of the gate is moved to a location behind the snow plow blade; and a hinge coupled to the gate and the snow plow blade, the gate pivotable between the deployed and stowed positions about an axis of the hinge, the axis of the hinge skewed in a generally upward and forward direction with respect to a direction of travel of the snow plow blade, wherein the gate is pivotable about the axis toward the deployed position in a generally forward and downward direction with respect to the direction of travel of the snow plow blade, and is pivotable about the axis toward the stowed position in a generally rearward and upward direction with respect to the direction of travel of the snow plow blade.

11. The gate assembly as claimed in claim 10, wherein the axis is skewed with respect to a substantially vertical plane by an angle greater than 0 degrees and less than about 10 degrees.

12. The gate assembly as claimed in claim 10, wherein:

the end of the snow plow blade is a first end;

the snow plow blade has an second end opposite the first end; and at least a portion of the gate is located between the first and second ends of the snow plow blade in the snow plow blade.

13. The gate assembly as claimed in claim 12, wherein the gate is substantially entirely between the snow plow blade and substantially entirely between the first and second ends of the snow plow blade.

14. The gate assembly as claimed in claim 10, wherein the hinge is proximate the end of the snow plow blade.

15. The gate assembly as claimed in claim 10, wherein the gate is pivotable through at least 180 degrees between the deployed and stowed positions.

16. The gate assembly as claimed in claim 10, further comprising an actuator having a first state in which the actuator secures the gate in the deployed position and a second state in which the gate is pivotable to the stowed position.

17. The gate assembly as claimed in claim 16, wherein:

the actuator includes a telescoping rod and cylinder; and the rod is movable into and out of engagement with the gate.

18. The gate assembly as claimed in claim 17, wherein the actuator is located proximate the end of the snow plow blade.

19. The gate assembly as claimed in claim 17, wherein the rod is removably received within an aperture in the gate to secure the gate in the deployed position.

20. The gate assembly as claimed in claim 17, wherein the actuator is automatically actuated responsive to the gate reaching the deployed position.

21. The gate assembly as claimed in claim 20, further comprising a motor drivably coupled to the gate, wherein the gate is driven between the deployed and stowed positions by the motor.

22. The gate assembly as claimed in claim 21, further comprising a sequence valve coupled to the actuator and motor, the sequence valve triggering actuation of the actuator responsive to the gate reaching the deployed position.

23. The gate assembly as claimed in claim 10, further comprising a motor drivably coupled to the gate, wherein the gate is driven between the deployed and stowed positions by the motor.

24. The gate assembly as claimed in claim 23, wherein the motor is located proximate the end of the snow plow blade.

25. The gate assembly as claimed in claim 10, wherein the gate is a first gate, the end of the snow plow blade is a first end, and the snow plow blade has a second end opposite the first end, the gate assembly further comprising a second gate located proximate the second end of the snow plow blade, the second gate pivotable with respect to the snow plow blade from a deployed position in which the second gate blocks snow from exiting the snow plow blade to a stowed position in which at least part of the second gate is moved to a location behind the snow plow blade.

26. The gate assembly as claimed in claim 25, wherein the second gate is movable independently of the first gate.

27. The gate assembly as claimed in claim 10, further comprising a wear member coupled to a lower edge of the gate.

28. A method of deploying a snow plow blade gate with respect to a snow plow blade having first and second opposite ends, the method comprising:

pivoting the gate away from a stowed position at least partially behind the snow plow blade and between the first and second ends of the snow plow blade;

pivoting the gate toward a deployed position;

lowering a lower edge of the gate by pivoting the gate from the stowed position toward the deployed position; and pivoting the gate to the deployed position adjacent the first end of the snow plow blade in which the gate blocks snow from exiting the first end of the snow plow blade.

29. The method as claimed in claim 28, wherein the lower edge of the gate is lowered while the gate is pivoted toward the deployed position.

30. The method as claimed in claim 28, wherein the gate pivots about an axis skewed with respect to a substantially vertical plane.

31. The method as claimed in claim 30, wherein the axis is located proximate the first end of the snow plow blade.

32. The method as claimed in claim 28, wherein pivoting the gate toward the deployed position includes pivoting the gate through at least 180 degrees.

33. The method as claimed in claim 32, wherein the gate is located substantially entirely behind the snow plow blade and substantially entirely between the first and second ends of the snow plow blade when in the stowed position.

34. The method as claimed in claim 28, further comprising actuating an actuator to pivot the gate.

35. The method as claimed in claim 34, further comprising actuating a second actuator to secure the gate in the deployed position.

36. The method as claimed in claim 35, wherein actuating the second actuator includes extending a rod with respect to a cylinder of the actuator into releasable engagement with the gate.

37. The method as claimed in claim 36, wherein actuating the second actuator further includes extending the rod into an aperture in the gate.

38. The method as claimed in claim 34, wherein the second actuator is automatically actuated when the gate reaches the deployed position.

39. The method as claimed in claim 34, wherein actuating the second actuator includes changing a state of a sequence valve coupled to the second actuator.

40. The method as claimed in claim 28, further comprising actuating an actuator to secure the gate in the deployed position after the gate has been pivoted to the deployed position.

* * * * *